US008770709B2

(12) United States Patent
Tanaka et al.

(10) Patent No.: US 8,770,709 B2
(45) Date of Patent: Jul. 8, 2014

(54) IMAGE FORMING APPARATUS AND METHOD OF DISCHARGING RECORDING LIQUID

(75) Inventors: Yuuji Tanaka, Osaka (JP); Yoichi Ito, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 57 days.

(21) Appl. No.: 13/480,673

(22) Filed: May 25, 2012

(65) Prior Publication Data

US 2012/0306966 A1 Dec. 6, 2012

(30) Foreign Application Priority Data

Jun. 3, 2011 (JP) ..... 2011-125653

(51) Int. Cl.
*B41J 2/165* (2006.01)

(52) U.S. Cl.
USPC ..... 347/30

(58) Field of Classification Search
None
See application file for complete search history.

(56) References Cited

U.S. PATENT DOCUMENTS

| | | | | |
|---|---|---|---|---|
| 8,167,401 | B2 * | 5/2012 | Kyoso | 347/30 |
| 2006/0176333 | A1 * | 8/2006 | Momose et al. | 347/30 |
| 2012/0056932 | A1 | 3/2012 | Matsubara et al. | |
| 2012/0056933 | A1 | 3/2012 | Tanaka et al. | |

FOREIGN PATENT DOCUMENTS

JP 2005-119214 5/2005

OTHER PUBLICATIONS

U.S. Appl. No. 13/297,677, filed Nov. 16, 2011.

* cited by examiner

*Primary Examiner* — Matthew Luu
*Assistant Examiner* — Alejandro Valencia
(74) *Attorney, Agent, or Firm* — Cooper & Dunham LLP

(57) ABSTRACT

An image forming apparatus includes a recording head oriented upward so as to eject a recording liquid upward. The recording head includes an ejection face, an ejection port, and a waste-liquid port. The ejection port is disposed at the ejection face to eject the recording liquid. The waste-liquid port is disposed separately from the ejection port at the ejection face. The waste-liquid passage is connected to the waste-liquid port and has an opening connected to an outside of the recording head. A residual of the recording liquid on the ejection face is discharged to the outside of the recording head via the waste-liquid port and the waste-liquid passage.

8 Claims, 8 Drawing Sheets

IMAGE FORMING APPARATUS AND METHOD OF DISCHARGING RECORDING LIQUID

CROSS-REFERENCE TO RELATED APPLICATION

This patent application is based on and claims priority pursuant to 35 U.S.C. §119 to Japanese Patent Application No. 2011-125653, filed on Jun. 3, 2011 in the Japan Patent Office, the entire disclosure of which is hereby incorporated by reference herein.

BACKGROUND

1. Technical Field

This disclosure relates to an image forming apparatus, and more specifically to an image forming apparatus including a recording head for ejecting recording liquid and a method of discharging the recording liquid from the recording head.

2. Description of the Related Art

Image forming apparatuses are widely used as printers, facsimile machines, copiers, plotters, or multi-functional devices having two or more of the foregoing capabilities. Such image forming apparatuses may have a recording head to eject recording liquid (e.g., ink) onto a recording medium (e.g., a sheet of paper) to form an image on the recording medium. The recording head is also referred to as, e.g., droplet ejection head, liquid ejection head, recording head, ink ejection head, or inkjet head.

In such an image forming apparatus, bubbles may enter nozzles of the recording head and reduce the ejection performance of the recording head. Hence, to recover the ejection performance, a conventional art is known to bring a cap into contact with a nozzle face of the recording head (also referred to as a recording-liquid ejection face, i.e., a face from which recording liquid is ejected) and suck the recording liquid from the recording head to discharge the bubbles from the nozzles (head sucking).

The above-described head suction is not problematic for an image forming apparatus having a recording head oriented vertically downward (so as to eject recording liquid vertically downward). However, the head suction causes the following problem in an image forming apparatus having a recording head oriented vertically upward (so as to eject recording liquid vertically upward).

For example, in a case where the above-described head suction is employed in an inkjet-type image forming apparatus having a recording head oriented vertically upward, a process from when the cap contacts the nozzle face of the recording head to when the pump sucks the recording liquid is not problematic. However, when the cap is decapped (detached) from the nozzle face after the head suction, residual ink in the cap may remain on the nozzle face since the head is oriented upward. Such ink remaining on the nozzle face may firmly adhere on the nozzle face or drip from the nozzle face to a side face of the head and solidify at the side face. As a result, ejection failure may occur in the nozzles or firmly-adhered ink may contaminate a recording face of a sheet of paper.

In this regard, for example, JP-2005-119214 proposes to clean a nipping portion of the cap by a cleaning member. When the cap moves to the capping position, the cap passes an opening of the cleaning member to remove residual ink on the nipping portion. Such a configuration can remove residual ink remaining on the nipping portion of the cap. However, in a case in which head suction is performed on a recording head oriented upward in an image forming apparatus, residual ink remaining in the cap during decapping the cap after head suction may remain on the nozzle face of the recording head.

BRIEF SUMMARY

In an aspect of this disclosure, there is provided an image forming apparatus including a recording head oriented upward so as to eject a recording liquid upward. The recording head includes an ejection face, an ejection port, and a waste-liquid port. The ejection port is disposed at the ejection face to eject the recording liquid. The waste-liquid port is disposed separately from the ejection port at the ejection face. The waste-liquid passage is connected to the waste-liquid port and has an opening connected to an outside of the recording head. A residual of the recording liquid on the ejection face is discharged to the outside of the recording head via the waste-liquid port and the waste-liquid passage.

In another aspect of this disclosure, there is provided a method of discharging a recording liquid. The method includes providing a recording head oriented upward so as to eject a recording liquid upward from an ejection port, and discharging a residual of the recording liquid on an ejection face of the recording head to an outside of the recording head via a waste-liquid port disposed separately from the ejection port at the ejection face and a waste-liquid passage connected to the waste-liquid port in the recording head.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
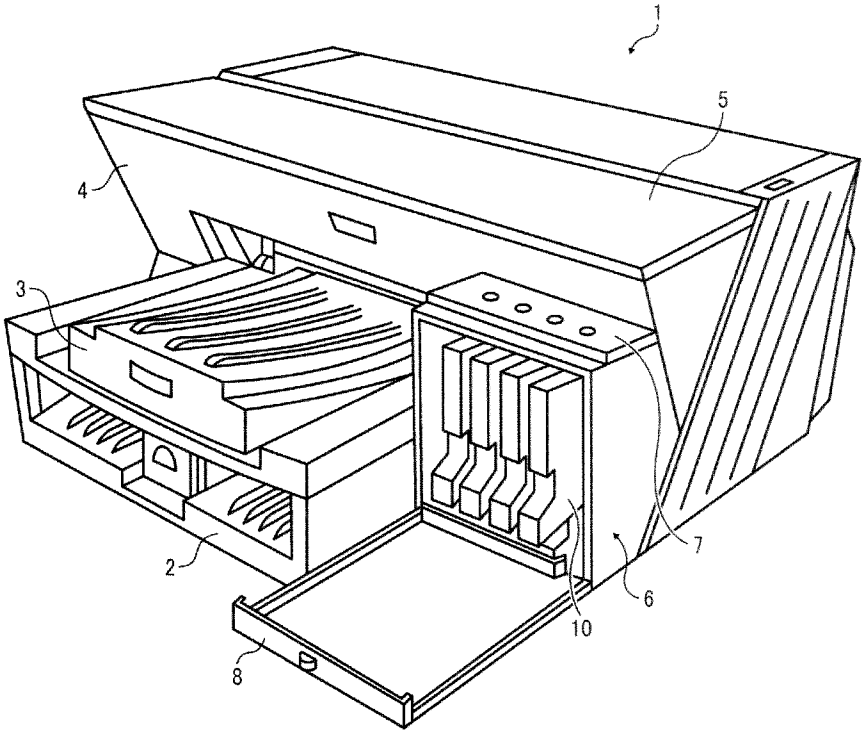
FIG. 1 is a perspective view of an image forming apparatus according to an exemplary embodiment of this disclosure, seen from its front side.

The accompanying drawings are intended to depict exemplary embodiments of the present disclosure and should not be interpreted to limit the scope thereof The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the invention and all of the components or elements described in the exemplary embodiments of this disclosure are not necessarily indispensable to the present invention.

Referring now to the drawings, wherein like reference numerals designate identical or corresponding parts throughout the several views, exemplary embodiments of the present disclosure are described below.

In an inkjet-type image forming apparatus according to an exemplary embodiment, a recording head is disposed so as to eject (droplets of) recording liquid upward, i.e., so that a nozzle face of the recording head is positioned at the upper side of the recording head. For operations of capping the nozzle face of the recording head and sucking the recording liquid from the head, the image forming apparatus has, for example, a feature that residual ink on the nozzle face (recording-liquid ejection face) is discharged through a waste liquid port at the nozzle face and a waste-liquid passage in the head by its weight or a suction pump. The feature is further described with reference to the drawings.

First, an image forming apparatus according to an exemplary embodiment is described below.

FIG. 1 is a perspective view of the image forming apparatus seen from its front side. As illustrated in FIG. 1, the image forming apparatus has a body 1, a sheet feed tray 2 mounted in the body 1 to store sheets, and a sheet output tray 3 mounted in the body 1 to stack the sheets after image recording (formation). At one end portion of a front face 4 of the body 1, the image forming apparatus has a cartridge mount part 6 that protrudes forward from the front face 4 and is positioned lower than an upper face 5 of the body 1. On the upper face 5 of the cartridge mount part 6 is disposed an operation unit 105 including, e.g., operation buttons and indicators. Main tanks (hereinafter, "ink cartridges") 10, i.e., liquid storage tanks serving as liquid replenishment units, are replaceably mounted in the cartridge mount part 6. An openable front cover 8 is mounted at a front side of the ink cartridges 10.

Figure 2:
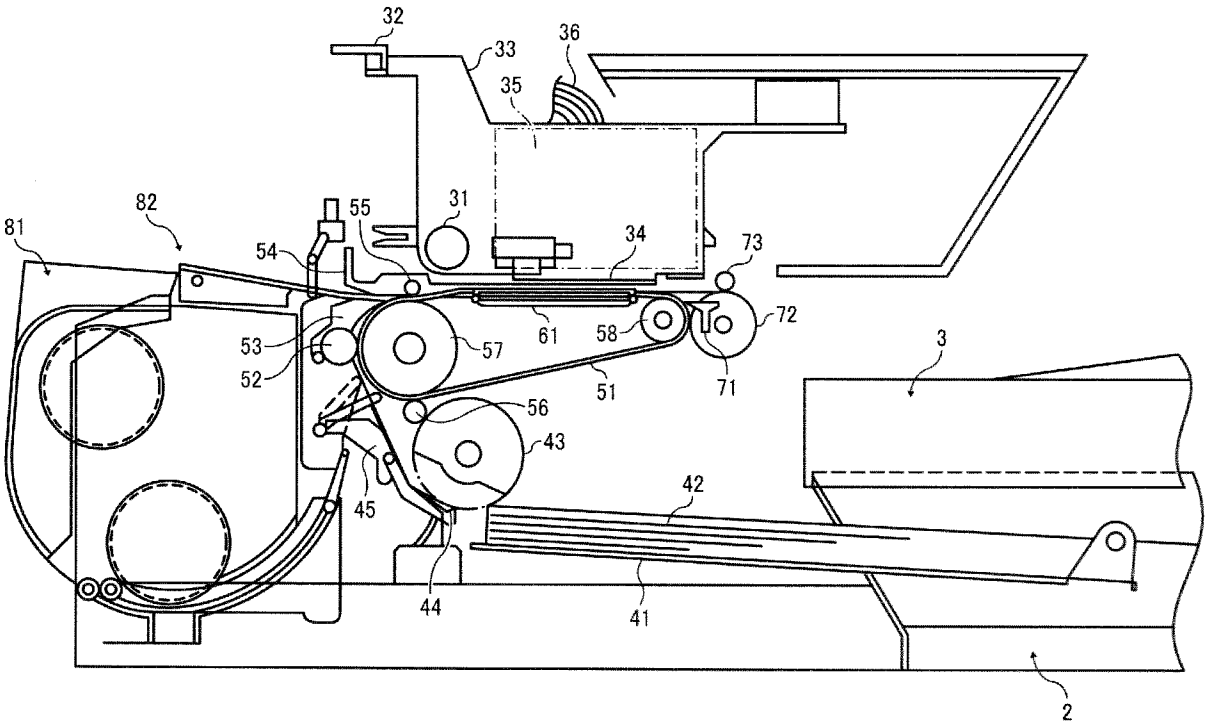
FIG. 2 is a schematic cross-sectional side view of a mechanical section of the image forming apparatus illustrated in FIG. 1.

FIG. 2 is a schematic cross-sectional side view of a mechanical section of the image forming apparatus illustrated in FIG. 1.

The image forming apparatus has a sheet feed section to feed sheets 42 stacked on a sheet stack portion (platen) 41 of a sheet feed tray 3. The sheet feed section further includes a sheet feed roller 43 and a separation pad 44. The sheet feed roller 43 of, e.g., a substantially half moon shape separates the sheets 42 from the sheet stack portion 41 and feeds the sheets 42 sheet by sheet. The separation pad 44 is disposed opposing the sheet feed roller 43 and is made of a material of a high friction coefficient. The separation pad 44 is also biased (urged) toward the sheet feed roller 43.

The image forming apparatus has a sheet conveyance section to convey the sheet 42 to an area below recording heads 34. The sheet conveyance section has a conveyance belt 51, a counter roller 52, a conveyance guide 53, a press member 54, and a front-end press roller 55. The conveyance belt 51 conveys the sheet 42 while adhering the sheet 42 by electrostatic force. The counter roller 52 receives the sheet 42 having sent from the sheet feed section via a first guide member 45 and sandwiches the sheet 42 between the conveyance belt 51 and the counter roller 52 to convey the sheet 42. The conveyance guide 53 turns the sheet 42 at substantially 90 degrees to guide the sheet 42 onto the conveyance belt 51. The front-end press roller 55 is urged toward the conveyance belt 51 by the press member 54. The sheet conveyance section also has a charging roller 56 serving as a charger to charge the surface of the conveyance belt 51.

Figure 3:
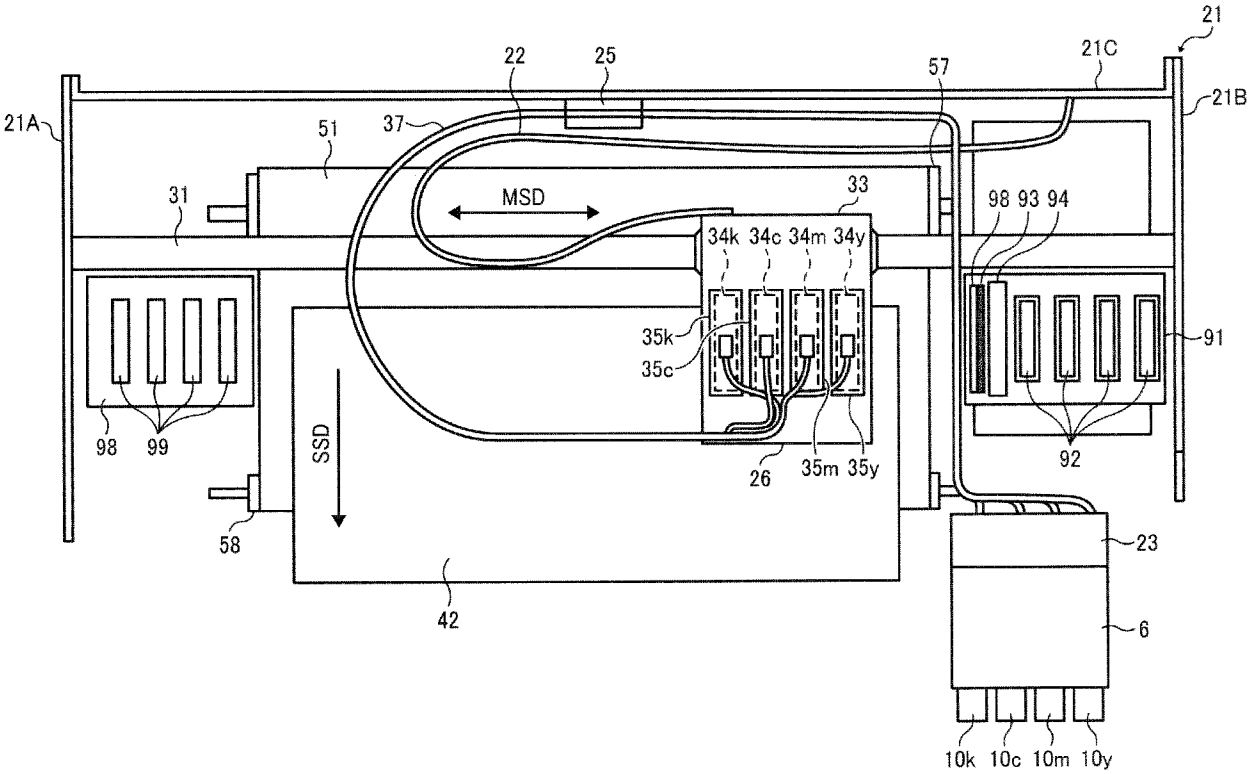
FIG. 3 is a schematic plan view of the mechanical section of the image forming apparatus illustrated in FIGS. 1 and 2.

The conveyance belt 51 is an endless belt that is looped between a conveyance roller 57 and a tension roller 58 so as to circulate in a belt conveyance direction, that is, a sub-scanning direction indicated by an arrow "SSD" illustrated in FIG. 3. The charging roller 56 is disposed so as to contact a surface layer of the conveyance belt 51 and rotate with the circulation of the conveyance belt 51. A pressing force of, e.g., 2.5N is applied to each end of a shaft of the charging roller 56.

In a back-side area of the conveyance belt 51 (inside the loop of the conveyance belt 51), a second guide member 61 is disposed at a position corresponding to a recording area of the recording heads 34. An upper face of the second guide member 61 is disposed to a position closer to the recording heads 34 than a tangent line of two rollers (the conveyance roller 57 and the tension roller 58) supporting the conveyance belt 51. Such a configuration allows the conveyance belt 51 to be pushed up and guided by the upper face of the second guide member 61, thus maintaining the flatness of the conveyance belt 51 at high precision.

The image forming apparatus has a sheet output section to output the sheet 42 on which an image has been formed by the recording heads 34. The sheet output section includes a separation claw 71 to separate the sheet 42 from the conveyance belt 51, a first output roller 72, and a second output roller 73. The sheet output tray 3 is disposed at a position lower than the first output roller 72. The height from the sheet output tray 3 to a position between the first output roller 72 and the second output roller 73 is set to be relatively high so as to be able to stack a large number of sheets.

A dual-side sheet feed unit 81 is detachably mounted on a rear side of the body 1. When the conveyance belt 51 rotates in reverse to return the sheet 42, the dual-side sheet feed unit 81 receives and turns the sheet 42 upside down to feed the sheet 42 between the counter roller 52 and the conveyance belt 51. A manual-feed tray 82 is disposed at an upper face of the dual-side sheet feed unit 81.

FIG. 3 is a schematic plan view of the mechanical section of the image forming apparatus illustrated in FIGS. 1 and 2.

In FIG. 3, a carriage 33 is held by a guide rod 31 and a stay 32 (see FIG. 2) so as to slidable in a main scanning direction indicated by an arrow MSD illustrated in FIG. 3. The guide rod 31 and the stay 32 serving as main and sub guide members extend between side plates 21A and 21B forming part of a frame 21. The carriage 33 is moved by a main scanning motor for scanning in the main scanning direction (carriage scanning direction) indicated by the arrow MSD in FIG. 3.

The carriage 33 has an ink ejection head for ejecting droplets of recording liquid (hereinafter, also referred to as "ink" or ink droplets"). The ink ejection head is formed with, for example, multiple recording heads 34 mounted on the carriage 33 so that multiple nozzles are arrayed in a direction perpendicular to the main scanning direction and ink droplets are ejected downward from the nozzles.

The recording heads 34 are, for example, recording heads 34*y*, 34*m*, 34*c*, and 34*k* for ejecting yellow (Y), cyan (C), magenta (M), and black (K) inks. Hereinafter, the recording heads 34*y*, 34*m*, 34*c*, and 34*k* are also referred to as "recording heads 34" unless colors distinguished.

It is to be noted that the head configuration of the recording heads 34 is not limited to the above-described configuration. The ink ejection head may be formed with one or more recording heads each having one or more nozzle rows.

As an energy generator for generating energy to eject ink, the ink ejection head may employ, for example, a piezoelectric actuator such as a piezoelectric element, a thermal actuator that generates film boiling of liquid (ink) using an electro/thermal converting element such as a heat-generation resistant to cause a phase change, a shape-memory-alloy actuator that changes metal phase by a temperature change, or an electrostatic actuator that generates pressure by electrostatic force.

The recording heads 34 mount driver ICs (integrated circuits) connected to a controller via a harness (flexible print cable) 22.

The carriage 33 mounts sub tanks 35*y*, 35*m*, 35*c*, and 35*k* (collectively referred to as "sub tanks 35" unless colors distinguished) to supply the color inks to the respective recording heads 34.

The recording liquids of different colors are supplied from the ink cartridges 10 (ink cartridges 10*y*, 10*c*, 10*m*, and 10*k*) to the sub tanks 35*y*, 35*m*, 35*c*, and 35*k* via recording-liquid supply tubes 37. The recording-liquid supply tubes 37 are dedicated for the respective color inks.

As illustrated in FIG. 3, the ink cartridges 10 are mounted in the cartridge mount part 6, and a supply pump unit 23 is mounted on the cartridge mount part 6 to feed recording liquids from the ink cartridges 10.

On the way on which the recording-liquid supply tubes 37 are wound around from the cartridge mount part 6 to the sub tanks 35, the recording-liquid supply tubes 37 are fixed and held on a rear plate 21C forming part of the frame 21 by a body-side holder 25. The recording-liquid supply tubes 37 are also fixed on the carriage 33 by a fixing rib 26.

As illustrated in FIG. 3, a reliability maintenance-and-recovery mechanism 91 (hereinafter, referred to as "sub system 91") is disposed at a non-printing area (non-recording area) that is located on one end in the main scanning direction of the carriage 33. The sub system 91 includes a maintenance device according to an exemplary embodiment of this disclosure to maintain and recover nozzle conditions of the recording heads 34.

The sub system 91 includes caps 92*a* to 92*d*, a wiper blade 93, a first droplet receptacle 94, a first wiper cleaner 95, and a cleaner roller 96. The caps 92*a* to 92*d* (hereinafter collectively referred to as "caps 92" unless distinguished) cap the nozzle faces of the recording heads 34. The wiper blade 93 is a blade member to wipe the nozzle faces of the recording heads 34. The first droplet receptacle 94 stores ink droplets ejected by maintenance ejection (flushing) in which ink not contributing to a resultant recorded image is ejected for, e.g, removing viscosity-increased ink. The first wiper cleaner 95 is integrally molded with the first droplet receptacle 94 and serves as a cleaning member to remove the recording liquid adhered to the wiper blade 93. The cleaner roller 96 serves as a cleaner to press the wiper blade 93 toward the first wiper cleaner 95 during cleaning of the wiper blade 93. The sub system 91 is further described below.

As illustrated in FIG. 3, in a non-printing area (non-recording area) at the opposite end in the main scanning direction of the carriage 33, a second droplet receptacle 98 is disposed to store ink ejected, during recording operation, by maintenance ejection in which ink not contributing to a resultant recorded image is ejected for, e.g., removing viscosity-increased ink. The second droplet receptacle 98 has openings 99 parallel to the nozzle rows of the recording heads 34.

As described above, the image forming apparatus illustrated in FIGS. 1 to 3 is described taking an example of the inkjet recording apparatus. Below, operation of the inkjet recording apparatus is described.

In the inkjet recording apparatus illustrated in FIG. 2, the sheet 42 is separated sheet by sheet from the sheet feed tray 2, fed in a substantially vertically upward direction, guided along the first guide member 45, and conveyed between the conveyance belt 51 and the counter roller 52. Further, the front tip of the sheet 42 is guided by the conveyance guide 53 and pressed against the conveyance belt 51 by the front-end press roller 55 to turn the conveyance direction of the sheet 42 by substantially 90 degrees.

At this time, through a control circuit, alternating voltages are applied from a high voltage power supply to the charging roller 56 so that plus outputs and minus outputs are alternately repeated. As a result, the conveyance belt 51 is charged with an alternately-charged voltage pattern, that is, an alternating band pattern of positively-charged areas and negatively-charged areas in the sub-scanning direction SSD, i.e., the belt circulation direction. When the sheet 42 is fed onto the conveyance belt 51 alternately charged with positive and negative voltages, the sheet 42 is adhered to the conveyance belt 3 by electrostatic force and conveyed in the sub scanning direction SSD by the circulation of the conveyance belt 3.

By driving the recording heads 34 in response to image signals while moving the carriage 33, ink droplets are ejected onto the sheet 42 stopped to form one band of a desired image. Then, the sheet 42 is fed by a certain distance to prepare for the next operation to record another band of the image. Receiving a signal indicating that the image has been recorded or the rear end of the sheet 42 has arrived at the recording area, the recording heads 34 finish the recording operation and the sheet 42 is output to the sheet output tray 3.

In waiting for the next recording (printing) operation, the carriage 33 moves to a side proximal to the sub system 91 and the caps 92 cap the recording heads 34. Thus, the moisture of the nozzles is kept to prevent an ejection failure due to ink drying. A recovery operation for discharging viscosity-increased recording liquid or bubbles is performed by sucking recording liquids from the nozzles with the recording heads 34 capped with the caps 92 ("nozzle suction" or "head suction"). Further, before or during recording operation, the above-described maintenance ejection is performed to eject ink not contributing to a resultant image, thus allowing stable ejection of the recording heads 134.

Figure 4:
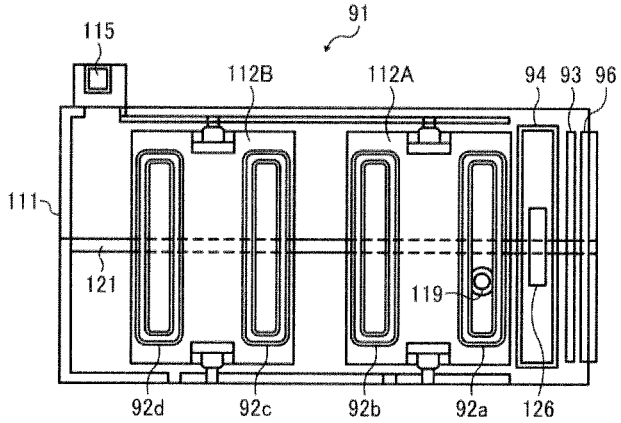
FIG. 4 is a schematic partially plan view of a sub system of an image forming apparatus according to an exemplary embodiment of this disclosure.
Figure 5:
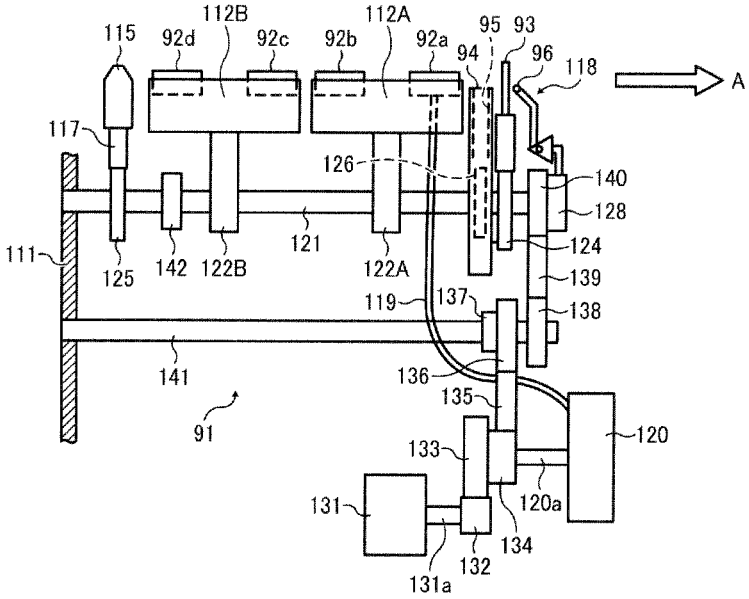
FIG. 5 is a schematic cross-sectional side view of the sub system.
Figure 6:
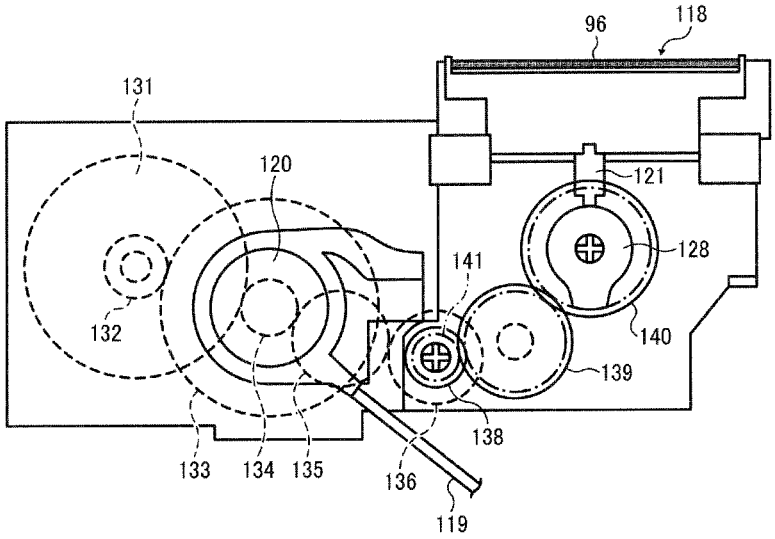
FIG. 6 is a side view of the sub system seen from the right side of FIG. 4.

Next, the sub system 91 is described with reference to FIGS. 4 to 6. FIG. 4 is a schematic partial plan view of the sub system 91. FIG. 5 is a schematic cross-sectional side view of the sub system 91. FIG. 6 is a side view of the sub system 91 seen from the right side of FIG. 4.

Two cap holders 112A and 112B serving as cap holding mechanism, the wiper blade 93 serving as a wiping member including an elastic body serving as a cleaning member, and a carriage lock 115 are held on a frame (maintenance-device frame) 111 of the sub system 91 so as to be movable up and down. The first droplet receptacle 94 is disposed between the wiper blade 93 and the cap holder 112A. A wiper cleaner 118 serving as a cleaner unit is swingably held to clean the wiper blade 93, and includes the cleaner roller 96 serving as a cleaning member to press the wiper blade 93 toward the wiper cleaner 95 serving as the cleaning member for the first droplet receptacle 94. The term "swing" used herein represents to simply "swing" or "rotate forward or in reverse at angles not greater than 360 degrees.

A first pair of caps 92*a* and 92*b* and a second pair of caps 92*c* and 92*d* to cap the respective nozzle faces of the two recording heads 34 are held on the cap holders 112A and 112B (hereinafter, "cap holders 112" unless distinguished), respectively.

In FIG. 5, the cap 92*a* held on the cap holder 112A most proximal to the recording area (disposed at a position in a direction indicated by an arrow A) is connected to a tubing pump (suction pump) 120 via a tube 119. The caps 92*b*, 92*c*, and 92*d* are not connected to the tubing pump 120. In other words, only the cap 92*a* serves as a cap for both suction (recovery) and moisture retention (hereinafter, simply referred to as "suction cap"), and the caps 92*b*, 92*c*, and 92*d* serve as a cap for moisture retention. Thus, to perform recovery operation, a target one of the recording heads 34 is selectively moved to a position at which the target one is capped by the cap 92*a*.

A cam shaft 121 rotatably supported by the frame 111 is disposed below the cap holders 112A and 112B. Cap cams 122A and 122B, a wiper cam 124, a carriage lock cam 125, a roller 126, a cleaner cam 128 are mounted on the cam shaft 121. The cap cams 122A and 122B move the cap holders 112A and 112B up and down, and the wiper cam 124 moves the wiper blade 93 up and down. The carriage lock cam 125 moves the carriage lock 115 up and down via a carriage lock arm 117. The roller 126 serves as a rotating body that is a maintenance-ejection adherence member to receive, in the first droplet receptacle 94, ink droplets ejected during maintenance ejection. The cleaner cam 128 swings the wiper cleaner 118.

The caps 92 are moved up and down by the cap cams 122A and 122B. The wiper blade 93 is moved up and down by the wiper cam 124. When the wiper blade 93 moves down, the wiper cleaner 118 moves toward the wiper blade 93. Then, while being sandwiched by the cleaner roller 96 of the wiper cleaner 118 and the first wiper cleaner 95 of the first droplet receptacle 94, the wiper blade 93 moves down. As a result, ink adhered to the wiper blade 93 is scraped off to the first droplet receptacle 94.

The carriage lock 115 is urged upward (in a lock direction) by a compression spring and moved up and down via the carriage lock arm 117 driven by the carriage lock cam 125.

To drive the tubing pump 120 and rotate the cam shaft 121, a pump gear 133 mounted on a pump shaft 120*a* of the tubing pump 120 is engaged with a motor gear 132 mounted on a motor shaft 131*a* of a motor 131. In addition, an intermediate gear 134 integrally molded with the pump gear 133 is engaged with an intermediate gear 136 having a one-way clutch 137 via an intermediate gear 135. An intermediate gear 138 coaxial to the intermediate gear 138 is engaged with a cam gear 140 fixed on the cam shaft 121 via an intermediate gear 139. An intermediate shaft 141 serving as a rotation shaft of the intermediate gears 136 and 138 is rotatably held by the frame 111.

The sub system 91 has a home position sensor to detect a home position and a cam 142 mounted on the cam shaft 121 to move the home position sensor. When the caps 92 move to the lowest position, a home position lever is activated with the home position sensor. As a result, the home position sensor turns into an open state to detect the home position of the motor 131 (except for the pump 120). When power is turned on, the home position sensor moves (elevates) up and down regardless of the positions of the caps 92 (the cap holders 112) and does not detect the home position of the caps 92 until the home position sensor starts to move. After the home position sensor detects the home position of the caps 92 (during moving up), the caps 92 are moved at a predetermined distance to the lowest position. Then, the carriage is moved in the horizontal (lateral) direction to return to a post-detection cap position, and the caps 92 cap the recording heads 34.

For the above-described example of image forming apparatus, the ink ejection head is oriented (mounted) in a downward direction so that ink droplets are ejected vertically downward. By contrast, for the image forming apparatus according to this exemplary embodiment, the ink ejection head is oriented in an upward direction so that ink droplets are ejected vertically upward. Except for the feature that the ink ejection head is oriented in the vertically upward direction, the configuration and operation of the image forming apparatus according to this exemplary embodiment are substantially the same as the configuration and operation described with reference to FIGS. 1 to 6.

Next, configuration examples of the image forming apparatus according to this exemplary embodiment are described below.

CONFIGURATION EXAMPLE 1

Figure 7:
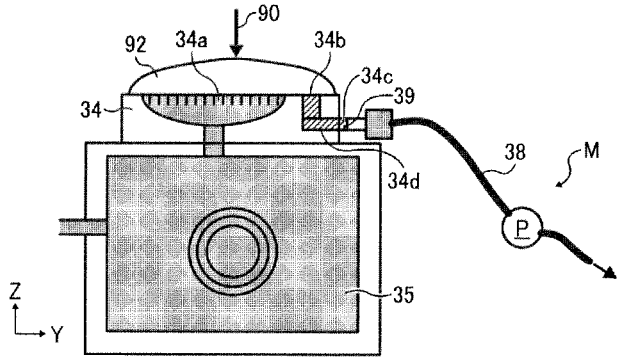
FIG. 7 is a schematic view of a configuration example 1 of a maintenance-and-recovery mechanism of an image forming apparatus according to an exemplary embodiment of this disclosure.

FIG. 7 shows a first configuration example of the maintenance-and-recovery mechanism of the image forming apparatus according to this exemplary embodiment.

For the image forming apparatus according to this exemplary embodiment, as illustrated in FIG. 7, the recording head 34 (nozzles 34*a*) is oriented upward so that ink stored in the head tank 35 is ejected vertically upward from the nozzles 34*a*. For such a configuration, if bubbles enter the nozzles 34*a* and cause ejection failure, as illustrated in FIG. 7, a first suction pump separately provided from a second suction pump P illustrated in FIG. 7 sucks ink upward from the recording head 34 in a state in which the suction cap 92 (also referred to as simply "cap") is brought into contact with the nozzle face of the recording head 34 (a face from which ink is ejected) by pressure of a pressing unit 90. After the suction, the suction cap 92 is separated from the recording head 34 (decapping). At this time, residual ink in the suction cap 92 might spread over the nozzle face and cause ink dripping. Ink dripped on a side face of the recording head 34 might become stiff In addition, residual ink might firmly adhere to the nozzle face, thus causing ejection failure or contamination of a recording sheet.

Hence, for the configuration example 1, as illustrated in FIG. 7, the recording head 34 has a hole 34*b* at the nozzle face (which differs from the nozzles 34*a* and is also referred to as "waste liquid port 34*b*") and a waste-liquid passage 34*d* connected to the waste liquid port 34*b* inside the recording head 34. The waste liquid port 34*b* may be finished to be water repellent. As illustrated in FIG. 7, the waste-liquid passage 34*d* has an opening 34*c* at a side face of the recording head 34.

The opening 34*c* is connected to an external member outside the recording head 34. FIG. 7 shows an example in which a maintenance unit M is connected to the opening 34*c* of the waste-liquid passage 34*d* at the side face of the recording head 34. The maintenance unit M includes, for example, a waste-liquid tube 38, the second suction pump P (an example of the suction unit), and a waste-liquid tank.

In the configuration example illustrated in FIG. 7, operation is performed as follows. For example, after sucking of bubbles and before decapping, a user connects a joint 39 of the maintenance unit M (provided at an end of the waste-liquid tube 38) to the opening 34*c* of the waste-liquid passage 34*d* provided at the side face of the recording head 34. The user instructs an operation (air sucking operation) of the second suction pump P. As a result, ink in the suction cap 92 (ink on the nozzle face) is sucked along with air from the waste liquid port 34*b* to the waste-liquid passage 34*d*, and further discharged through the waste-liquid tube 38 and the suction pump to the waste-liquid tank. It is to be noted that the connection of the opening 34*c* of the waste-liquid passage 34*d* to the maintenance unit M is not limited to the above-described user's manual connection. For example, by movement of the carriage in the main scanning direction, the opening 34*c* may be connected to the maintenance unit M. During cleaning of the recording head 34, the waste liquid port 34*b* may be cleaned together with the recording head 34.

CONFIGURATION EXAMPLE 2

Figure 8:
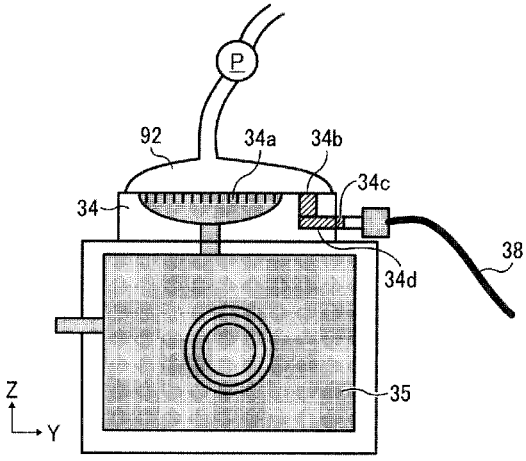
FIG. 8 is a schematic view of a configuration example 2 of a maintenance-and-recovery mechanism of an image forming apparatus according to an exemplary embodiment of this disclosure.

FIG. 8 shows a second configuration example of the maintenance-and-recovery mechanism of the image forming apparatus according to this exemplary embodiment.

The above-described configuration example 1 illustrated in FIG. 7 may be disadvantageous in the performance of discharging waste liquid during decapping. Hence, for this configuration example 2, as illustrated in FIG. 8, a suction unit (e.g., a suction pump P) is connected to a suction cap 92 (and a suction pump is not provided at a waste-liquid tube 38). After head suction is finished, the direction in which air flows is reversed to release air to the atmosphere. Thus, air is sent into the suction cap 92, thus facilitating waste-liquid discharge.

For example, in FIG. 8, during head suction, the suction unit (e.g., the suction pump P) sucks bubbles from nozzles 34*a* and further sucks the bubbles upward. In other words, bubbles (in ink) sucked from the nozzles are further sucked upward (toward the suction unit). After the head suction is finished, the suction unit reverses the direction in which air flows during the head suction. In other words, the suction unit feeds air into the suction cap 92 (causes air to enter the inside of the suction cap 92). At this time, the suction unit acts as an air inflow unit (air feed unit). Thus, for the configuration example 2, the suction unit reverses the air flow direction to switch the operation between head suction and air inflow.

When air flows into the suction cap 92, ink in the suction cap 92 (ink on the nozzle face) is pushed by the air flowing into the suction cap 92 to flow from a waste liquid port 34*b* at the nozzle face to a waste-liquid passage 34*d*. Then, the ink is discharged through a waste-liquid tube 38 to a waste-liquid tank. By flowing air into the suction cap 92 as described above, waste liquid can be effectively discharged.

CONFIGURATION EXAMPLE 3

Figure 9:
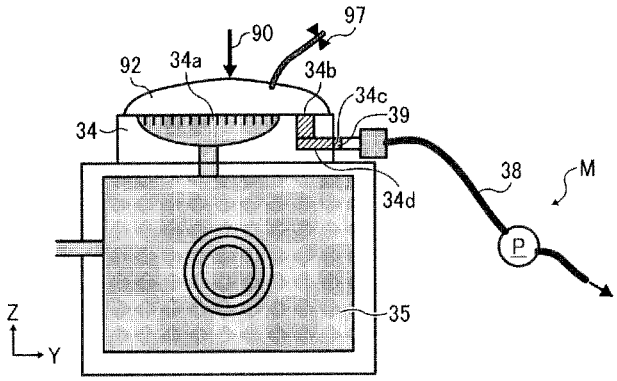
FIG. 9 is a schematic view of a configuration example 3 of a maintenance-and-recovery mechanism of an image forming apparatus according to an exemplary embodiment of this disclosure.

FIG. 9 shows a third configuration example of the maintenance-and-recovery mechanism of the image forming apparatus according to this exemplary embodiment.

For this configuration example 3, as illustrated in FIG. 9, an air release valve 97 is connected to the suction cap 92 in the configuration of FIG. 7, thus obtaining effects equivalent to the above-described effects. The air release valve 97 is disposed at a position opposing the waste liquid port 34*b* (the hole at the nozzle face) in a direction indicated by an arrow Z in FIG. 9. As with the above-described configuration example 2, after head suction is finished, the air release valve 97 feeds air into the suction cap 92 (toward the nozzle face in the suction cap 92). The air release valve 97 is dedicated for the air feed operation (and does not perform sucking operation). As a result, ink in the suction cap 92 (ink on the nozzle face) is pushed by air flowing into the suction cap 92 to flow toward the waste liquid port 34*b*, and further discharged from the waste-liquid passage 34*d* through the waste-liquid tube 38 to the waste-liquid tank. By flowing air into the suction cap 92 as described above, waste liquid can be effectively discharged.

CONFIGURATION EXAMPLE 4

Figure 10:
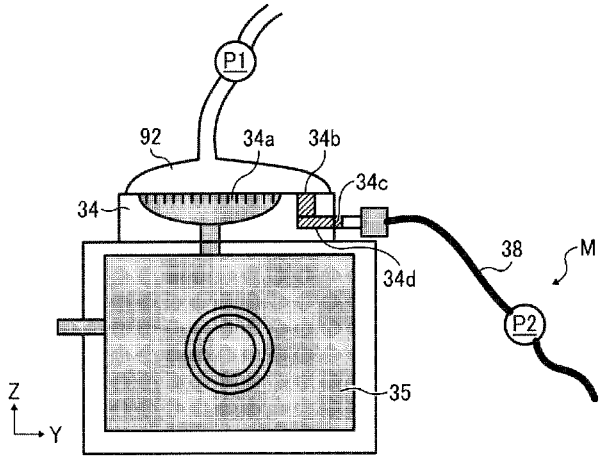
FIG. 10 is a schematic view of a configuration example 4 of a maintenance-and-recovery mechanism of an image forming apparatus according to an exemplary embodiment of this disclosure.

FIG. 10 shows a fourth configuration example of the maintenance-and-recovery mechanism of the image forming apparatus according to this exemplary embodiment.

To obtain higher liquid discharging performance, as illustrated in FIG. 10, a second suction unit P2 (e.g., a suction pump P2) may be provided in addition to a first suction unit P1 connected to the suction cap 92. The second suction unit P2 is connected to a waste-liquid tube 38. The waste-liquid tube 38 has a joint 39 at its one end and is connected to an opening 34*c* of a waste-liquid passage 34*d* via the joint 39. In other words, the configuration illustrated in FIG. 10 is a combination of the configurations illustrated in FIGS. 7 and 8. Operations of the two suction units P1 and P2 illustrated in FIG. 10 are the same as those of the configuration examples 1 and 2 and descriptions thereof are omitted here. As described above, the configuration illustrated in FIG. 10 can further enhance the liquid discharging performance.

It is to be noted that the two suction units illustrated in FIG. 10 may be driven by a single driving source. Such a configuration can reduce the number and cost of components.

CONFIGURATION EXAMPLE 5

Figure 11:
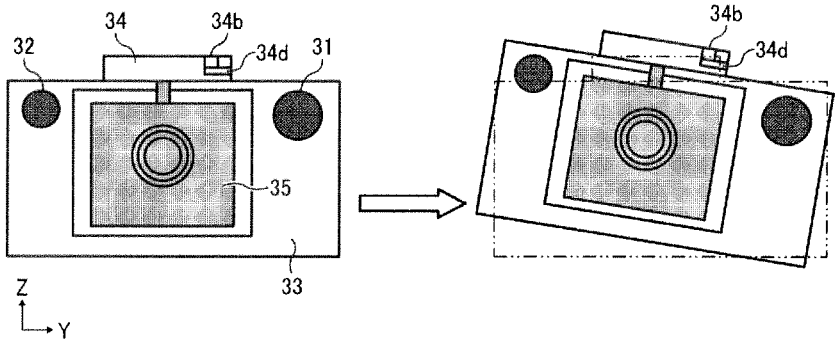
FIG. 11 is a schematic view of a configuration example of an image forming apparatus according to an exemplary embodiment of this disclosure, in which tilting operation is performed on a recording head.

FIG. 11 shows a fifth configuration example of the image forming apparatus according to this exemplary embodiment, in which tilting operation is performed on a recording head 34. In FIG. 11, nozzles of the recording head 34 and a maintenance unit M connected to an opening of a waste-liquid passage 34*d* are omitted for simplicity.

As illustrated in the left side (normal state) of FIG. 11, in a case where a nozzle face of the recording head 34 is horizontally disposed, ink is likely to remain on the nozzle face, thus hampering effective suction. Hence, during maintenance operation, a main guide member 31 to support a carriage 33 and a sub guide member 32 disposed parallel to the main guide member 31 to support the carriage 33 may relatively move in a Z direction in FIG. 11 so as to tilt a waste liquid port 34*b* downward relative to the vertical direction, as illustrated in the right side (during maintenance operation) of FIG. 11. In other words, the main guide member 31 and the sub guide member 32 serve as a tilting unit to tilt the waste liquid port 34*b* downward relative to the vertical direction. Such a configuration allows ink to move on the inclined nozzle face by its weight and be sucked into the waste liquid port 34*b*, thus allowing effective ink discharging.

In the recording head 34 illustrated in FIG. 11, a plurality of sets of waste liquid ports 34*b* and waste-liquid passages 34*d* connected to the waste liquid ports 34*b* may be provided. Such a configuration can shorten the time of sucking ink.

It is to be noted that the configuration example 5 may be used in combination with any of the above-described configuration examples 1 to 4.

CONFIGURATION EXAMPLE 6

Figure 12:
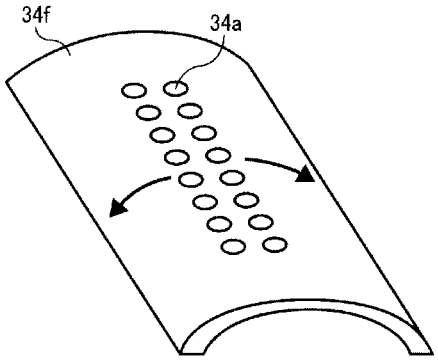
FIG. 12 is a schematic view of a configuration example of an image forming apparatus according to an exemplary embodiment of this disclosure, in which a nozzle face of a recording head is curved.

FIG. 12 shows a sixth configuration example of the image forming apparatus according to this exemplary embodiment, in which a recording head has a curved nozzle face.

As illustrated in FIG. 12, a nozzle face 34*f* of a recording head 34 may have a curvature. Such a configuration allows ink to be collected to each lateral edge of the nozzle face 34*f*, thus facilitating ink to flow into a waste liquid port. The waste liquid port may be formed at an area other than the nozzle face 34*f* or at the nozzle face 34*f* as in the above-described configuration examples 1 to 5.

It is to be noted that the configuration example 6 may be used in combination with any of the above-described configuration examples 1 to 5.

As described above, according to this exemplary embodiment, residual ink on the nozzle face is discharged through the waste liquid port at the nozzle face and the waste-liquid passage in the recording head by its weight or the suction unit. Such a configuration can prevent ink from remaining on the nozzle face in decapping after head suction in an image forming apparatus in which a recording head is arranged so as to eject ink upward, As a result, such a configuration can prevent Ink remaining on the nozzle face from dripping and firmly adhering on a side face of the recording head, thus preventing ejection failure due to firmly-adhered ink.

Numerous additional modifications and variations are possible in light of the above teachings. It is therefore to be understood that, within the scope of the appended claims, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

For example, in the above-described exemplary embodiment, the recording head is oriented in a vertically upward direction. However, it is to be noted that the orientation of the recording head is not limited to the vertically upward direction and may be, for example, inclined relative to the vertical direction.

In other words, the direction in which recording liquid is ejected from the recording head is not limited to the vertically upward direction but, for example, recording liquid may be ejected obliquely upward. Alternatively, the nozzle face of the recording head may not be horizontally disposed as illustrated in FIG. 7. For example, to the extent that the nozzle face of the recording head is not vertical, the nozzle face of the recording head may be inclined relative to the horizontal direction so that the direction in which recording liquid is ejected is inclined relative to the vertically upward direction.

What is claimed is:

1. An image forming apparatus comprising:

a recording head oriented upward so as to eject a recording liquid upward; and a suction cap provided above the recording head to suction residual recording liquid upward from the recording head in a state in which the suction cap is in contact with an ejection face of the recording head, the recording head comprising the ejection face, an ejection port at the ejection face to eject the recording liquid, a waste-liquid port disposed at the ejection face of the recording head and separately from the ejection port, the waste-liquid port of the recording head including a hole formed at the ejection face of the recording head and a waste-liquid passage provided inside the recording head and connected to the waste-liquid port at the ejection face and additionally having an opening disposed at a side face of the recording head to be connected to a suction unit provided outside of the recording head and the suction cap, the suction unit being connected to the opening of the recording head, which is formed outside a capping area to be covered by the suction cap, and is not connected to the suction cap, wherein the suction unit suctions a residual of the recording liquid that is outside the ejection face between the suction cap and the ejection face of the recording head and discharges the suctioned residual to an outside of the recording head via the waste-liquid port, the waste-liquid passage and the opening of the recording head without passing through the suction cap.

2. The image forming apparatus of claim 1, further comprising the suction unit connected to the opening of the waste-liquid passage, wherein the suction unit sucks the residual of the recording liquid on the ejection face from the waste-liquid port along with air to discharge the residual to the outside of the recording head via the waste-liquid passage.

3. The image forming apparatus of claim 1, further comprising an air inflow unit to feed air toward the ejection face, wherein the residual of the recording liquid on the ejection face is pushed by the air to enter the waste-liquid port and be discharged to the outside of the recording head via the waste-liquid passage.

4. The image forming apparatus of claim 3, further comprising a cap detachably mounted to the recording head so as to cover the ejection face to suck the recording liquid from the ejection port at an occurrence of ejection failure of the recording liquid, wherein the air inflow unit is connected to the cap and sucks the recording liquid from the ejection port at the occurrence of ejection failure, and the air inflow unit switches between sucking of the recording liquid from the ejection port and feeding of air toward the ejection face by reversing an air flow direction.

5. The image forming apparatus of claim 3, further comprising a cap detachably mounted to the recording head so as to cover the ejection face to suck the recording liquid from the ejection port at an occurrence of ejection failure of the recording liquid, wherein the air inflow unit is connected to the cap and dedicated to feed air toward the ejection face.

6. The image forming apparatus of claim 1, further comprising a tilting unit to tilt the ejection face so as to flow the residual of the recording liquid from the ejection face into the waste-liquid port by weight of the residual.

7. The image forming apparatus of claim 1, wherein the ejection face is curved.

8. A method of discharging a recording liquid, the method comprising steps of:

providing a recording head oriented upward so as to eject a recording liquid upward from an ejection port, and providing a suction cap above the recording head to suction residual recording liquid upward from the recording head in a state in which the suction cap is in contact with an ejection face of the recording head, the recording head including (i) a waste-liquid port disposed in or on the ejection face of the recording head and separately from the ejection port, (ii) a waste-liquid passage provided inside the recording head and connected to the waste-liquid port in the recording head and (iii) an opening disposed at a side face of the recording head; and suctioning, by suction applied by a suction unit provided outside of the recording head and the suction cap and connected to the opening of the recording head, which is formed outside a capping area to be covered by the suction cap, and is not connected to the suction cap, a residual of the recording liquid that is outside the ejection face between the suction cap and the ejection face of the recording head and discharging the suctioned residual to an outside of the recording head via the waste-liquid port, waste-liquid passage and opening of the recording head without passing through the suction cap.

* * * * *